US008870533B2

(12) United States Patent
Casavant

(10) Patent No.: US 8,870,533 B2
(45) Date of Patent: Oct. 28, 2014

(54) ASSEMBLY FOR ALIGNING AN INNER SHELL OF A TURBINE CASING

(75) Inventor: Matthew Stephen Casavant, Greenville, SC (US)

(73) Assignee: General Electric Company, Schenectady, NY (US)

( * ) Notice: Subject to any disclaimer, the term of this patent is extended or adjusted under 35 U.S.C. 154(b) by 569 days.

(21) Appl. No.: 13/181,812

(22) Filed: Jul. 13, 2011

(65) Prior Publication Data

US 2013/0017082 A1 Jan. 17, 2013

(51) Int. Cl.
*F01D 11/22* (2006.01)
*F01D 25/28* (2006.01)
*F04D 29/64* (2006.01)

(52) U.S. Cl.
CPC ..... *F01D 25/285* (2013.01); *F04D 29/644* (2013.01); *F01D 11/22* (2013.01); *F01D 25/28* (2013.01)
USPC ..... 415/213.1

(58) Field of Classification Search
USPC ..... 415/213.1
See application file for complete search history.

(56) References Cited

U.S. PATENT DOCUMENTS

| | | | | |
|---|---|---|---|---|
| 3,062,497 | A * | 11/1962 | Howes et al. | 415/126 |
| 3,628,884 | A * | 12/1971 | Mierley, Sr. | 415/213.1 |
| 4,817,417 | A | 4/1989 | Twerdochlib | |
| 6,606,935 | B2 * | 8/2003 | Jones | 92/13.7 |
| 7,581,922 | B1 | 9/2009 | Morimoto et al. | |
| 7,637,110 | B2 * | 12/2009 | Czachor et al. | 60/796 |
| 8,182,207 | B2 * | 5/2012 | Ballard et al. | 415/126 |
| 8,231,338 | B2 * | 7/2012 | Ballard et al. | 415/136 |
| 2010/0284792 | A1 | 11/2010 | Ballard, Jr. et al. | |

* cited by examiner

*Primary Examiner* — Ned Landrum
*Assistant Examiner* — Brian O Peters
(74) *Attorney, Agent, or Firm* — Dority & Manning, P.A.

(57) ABSTRACT

An alignment assembly for mounting and aligning an inner shell within an outer shell is disclosed. The alignment assembly generally includes a first bushing and a second bushing configured to be received within at least one of an arm extending radially between the inner and outer shells and a boss of the outer shell. The first bushing may generally have an eccentric configuration and the second bushing may include an eccentric portion extending within the first bushing. Additionally, the alignment assembly may include a connection member extending within at least one of said first bushing and said second bushing.

15 Claims, 7 Drawing Sheets

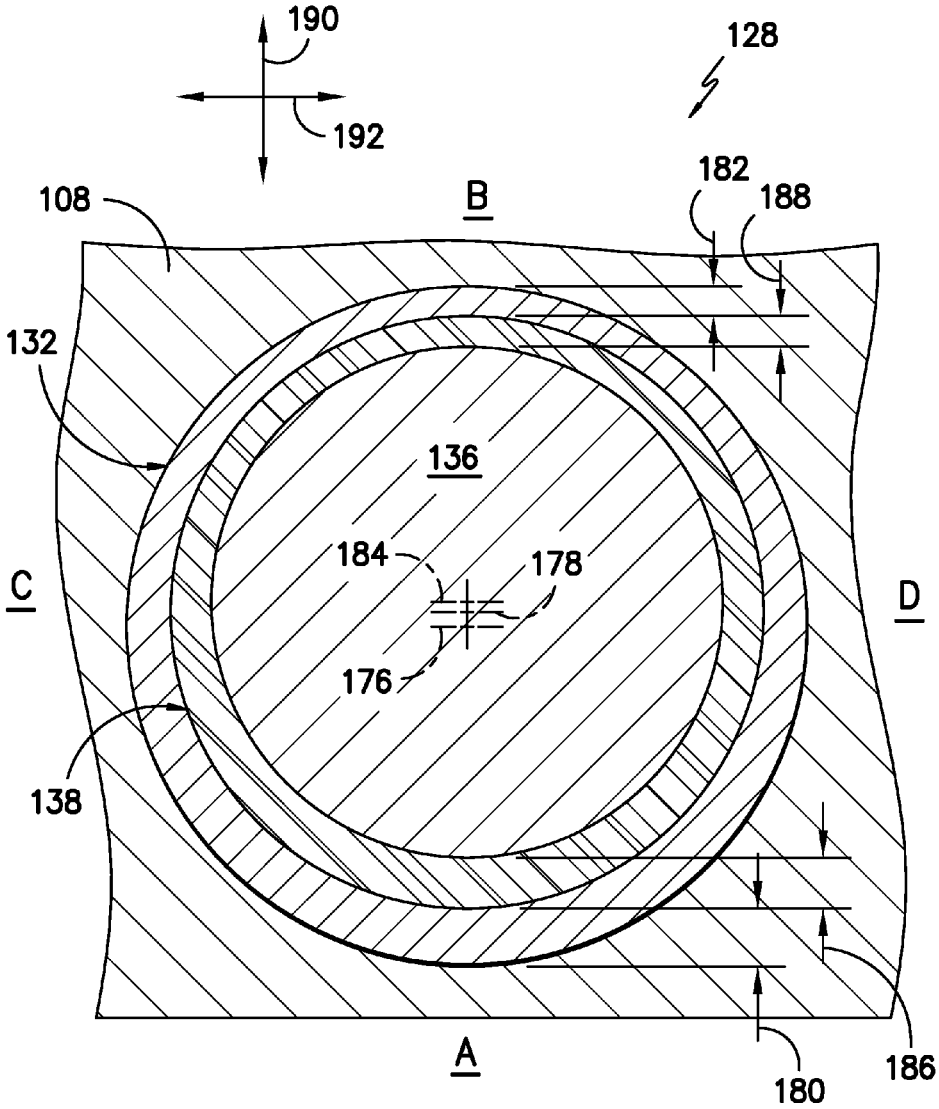
FIG. —7—

ASSEMBLY FOR ALIGNING AN INNER SHELL OF A TURBINE CASING

FIELD OF THE INVENTION

The present subject matter relates generally to a casing for a gas turbine and, more particularly, to an alignment assembly for aligning an inner turbine shell relative to a rotor centerline of a gas turbine.

BACKGROUND OF THE INVENTION

Turbines and other forms of commercial equipment frequently include rotating components inside or proximate to stationary components. For example, a typical gas turbine includes a compressor at the front, one or more combustors radially disposed about the middle, and a turbine at the rear. The compressor includes multiple stages of stationary vanes and rotating blades. Ambient air enters the compressor, and the stationary vanes and rotating blades progressively impart kinetic energy to the air to bring it to a highly energized state. The working fluid exits the compressor and flows to the combustors where it mixes with fuel and ignites to generate combustion gases having a high temperature and pressure. The combustion gases exit the combustors and flow through the turbine. A casing generally surrounds the turbine to contain the combustion gases as they flow through alternating stages of fixed nozzles and rotating buckets. For example, conventional turbine casings generally include one or more inner turbine shells surrounding the turbine rotor and an outer turbine shell surrounding the inner turbine shell(s). The fixed nozzles may be attached to the inner turbine shell(s) and the rotating buckets may be attached to the turbine rotor. Thus, as the combustion gases flow within the inner turbine shell(s) and through the nozzles, they are directed to the buckets, and thus the turbine rotor, to create rotation and produce work.

The clearance in the turbine between the inner turbine shell(s) and the rotating components is an important design consideration that balances efficiency and performance on the one hand with manufacturing and maintenance costs on the other hand. For example, reducing the clearance between the inner turbine shell(s) and the rotating components generally improves efficiency and performance of the turbine by reducing the amount of combustion gases that bypass the rotating buckets. However, reduced clearances may also result in additional manufacturing costs and increased maintenance costs attributed to increased rubbing, friction, or impact between the rotating components and the inner turbine shell(s).

Excessive rubbing between the rotating components and the inner turbine shell(s) may be particularly problematic during transient operations when the inner turbine shell(s) expands or contracts at a different rate than the rotating components. Specifically, during transient operations, temperature changes in the turbine produce axial and radial temperature gradients in the inner turbine shell(s), which can greatly affect the clearance between the inner turbine shell(s) and the rotating buckets.

In order to achieve tight clearances within a turbine (especially during transient operations), the inner turbine shell(s) must be properly aligned with the centerline of the turbine rotor. Some current methods for aligning the inner turbine shell(s) relative to the turbine centerline require extensive drilling and other machining to be performed in the field, which can be very labor and time intensive. Many also required sliding and gapped interfaces adding to eccentricity stack-up and dependency on friction. Moreover, these current methods often require service workers to gain access to the interior of the outer turbine shell, which may necessitate disassembly of one or more components of the turbine.

Accordingly, an alignment assembly that permits the alignment of an inner turbine shell relative to the rotor centerline to be adjusted quickly and easily would be welcomed in the technology.

BRIEF DESCRIPTION OF THE INVENTION

Aspects and advantages of the invention will be set forth in part in the following description, or may be obvious from the description, or may be learned through practice of the invention.

In one aspect, an alignment assembly for mounting and aligning an inner shell within an outer shell wherein an arm extends radially between the inner and outer shells is disclosed. The alignment assembly generally includes a first bushing and a second bushing configured to be received within at least one of the arm and a boss of the outer shell. The first bushing may generally have an eccentric configuration and the second bushing may include an eccentric portion extending within the first bushing. Additionally, the alignment assembly may include a connection member extending within at least one of said first bushing and said second bushing.

In another aspect, a casing assembly is disclosed. The casing assembly may generally include an inner shell and an outer shell surrounding the inner shell. The outer shell may include a boss extending radially from a surface of the outer shell. The casing assembly may also include an arm extending radially between a first end and a second end. The first end may be coupled to the inner shell and the second end may extend adjacent to the boss. Additionally, the casing assembly may include an alignment assembly extending through at least a portion of the arm and the boss. The alignment assembly may include a first bushing having an eccentric configuration, a second bushing having an eccentric portion extending within the first bushing and a connection member extending within at least one of the first bushing and the second bushing.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 7 illustrates a cross-sectional-view of the shell alignment assembly shown in FIG. 6 taken along line 7-7, particularly illustrating the double eccentric bushing configuration of the shell alignment assembly.

DETAILED DESCRIPTION OF THE INVENTION

Figure 1:
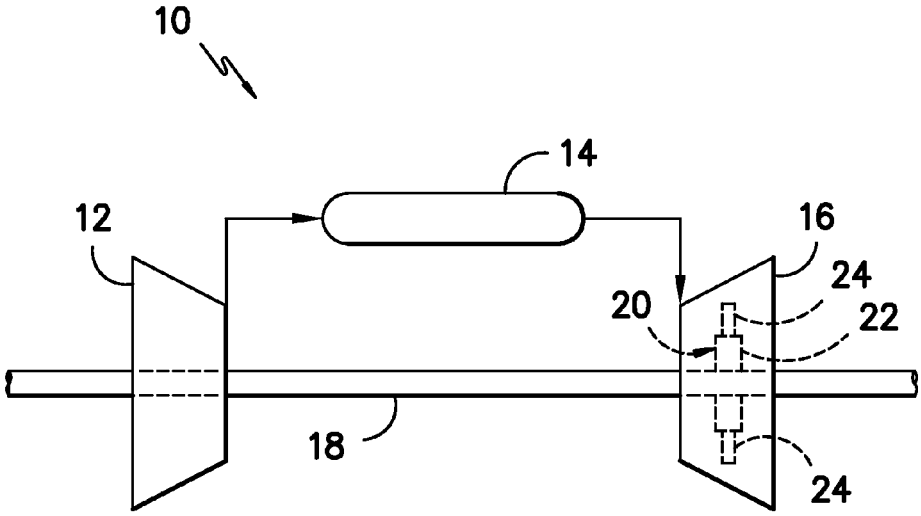
FIG. 1 illustrates a schematic depiction of one embodiment of a gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a shell alignment assembly for mounting and aligning an inner shell within an outer shell. In several embodiments, the shell alignment assembly may generally be located at an exterior position on the outer shell and may include a double eccentric bushing configuration. Thus, by rotating the eccentric bushings relative to one another, the alignment of the inner shell may be quickly and easily adjusted without the necessity of gaining access to the interior of the outer shell.

Referring now to the drawings, FIG. 1 illustrates a schematic diagram of one embodiment of a gas turbine 10. The gas turbine 10 generally includes a compressor section 12, a plurality of combustors (not shown) within a combustor section 14 disposed downstream of the compressor section 12, and a turbine section 16 disposed downstream of the combustor section 14. Additionally, the gas turbine 10 may include a shaft 18 coupled between the compressor section 12 and the turbine section 16. The turbine section 16 may generally include a turbine rotor 20 having a plurality of rotor disks 22 (one of which is shown) and a plurality of turbine buckets 24 extending radially outwardly from and being coupled to each rotor disk 22 for rotation therewith. The rotor disks 22 may, in turn, be coupled to the shaft 18

During operation of the gas turbine 10, the compressor section 12 pressurizes air entering the gas turbine 10 and supplies the pressurized air to the combustors of the combustor section 14. The pressurized air is mixed with fuel and burned within each combustor to produce hot gases of combustion. The hot gases of combustion flow in a hot gas path from the combustor section 14 to the turbine section 16, wherein energy is extracted from the hot gases by the turbine buckets 24. The energy extracted by the turbine buckets 24 is used to rotate the rotor disks 22 which may, in turn, rotate the shaft 18. The mechanical rotational energy may then be used to power the compressor section 12 and generate electricity.

Figure 2:
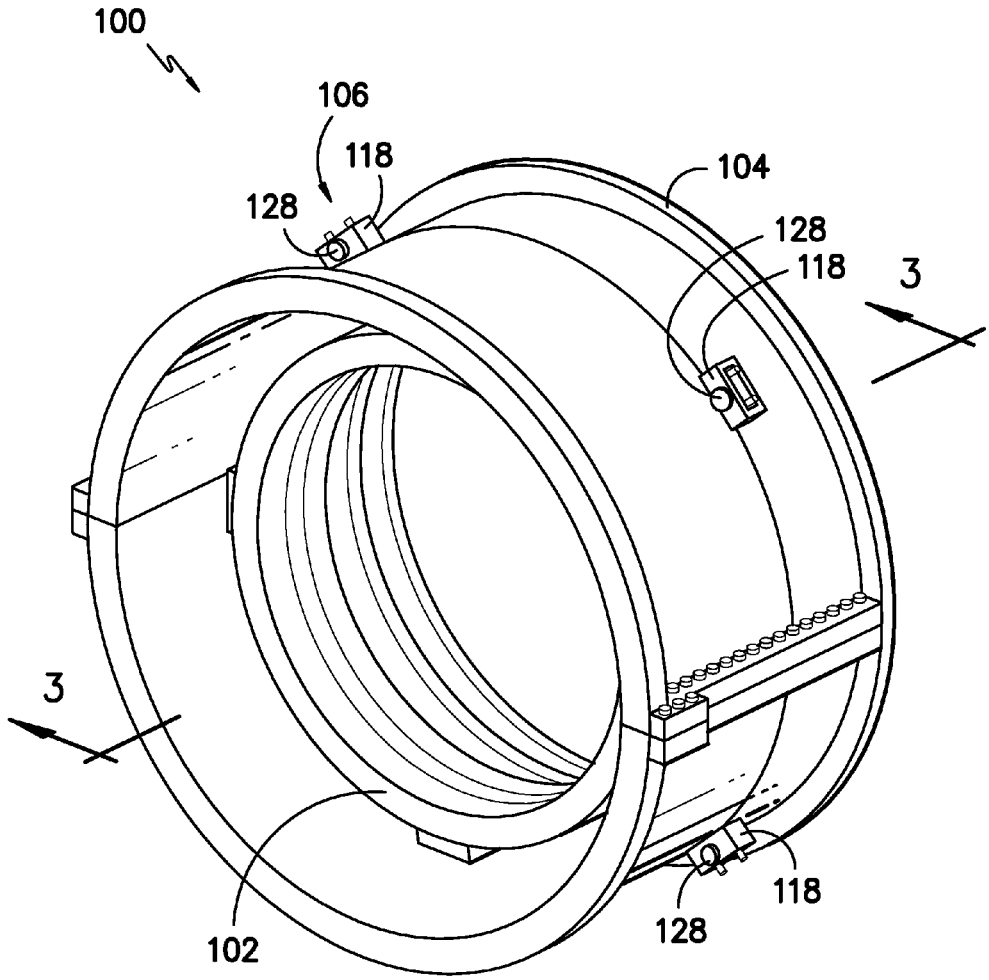
FIG. 2 illustrates a perspective view of one embodiment of a casing assembly in accordance with aspects of the present subject matter.
Figure 3:
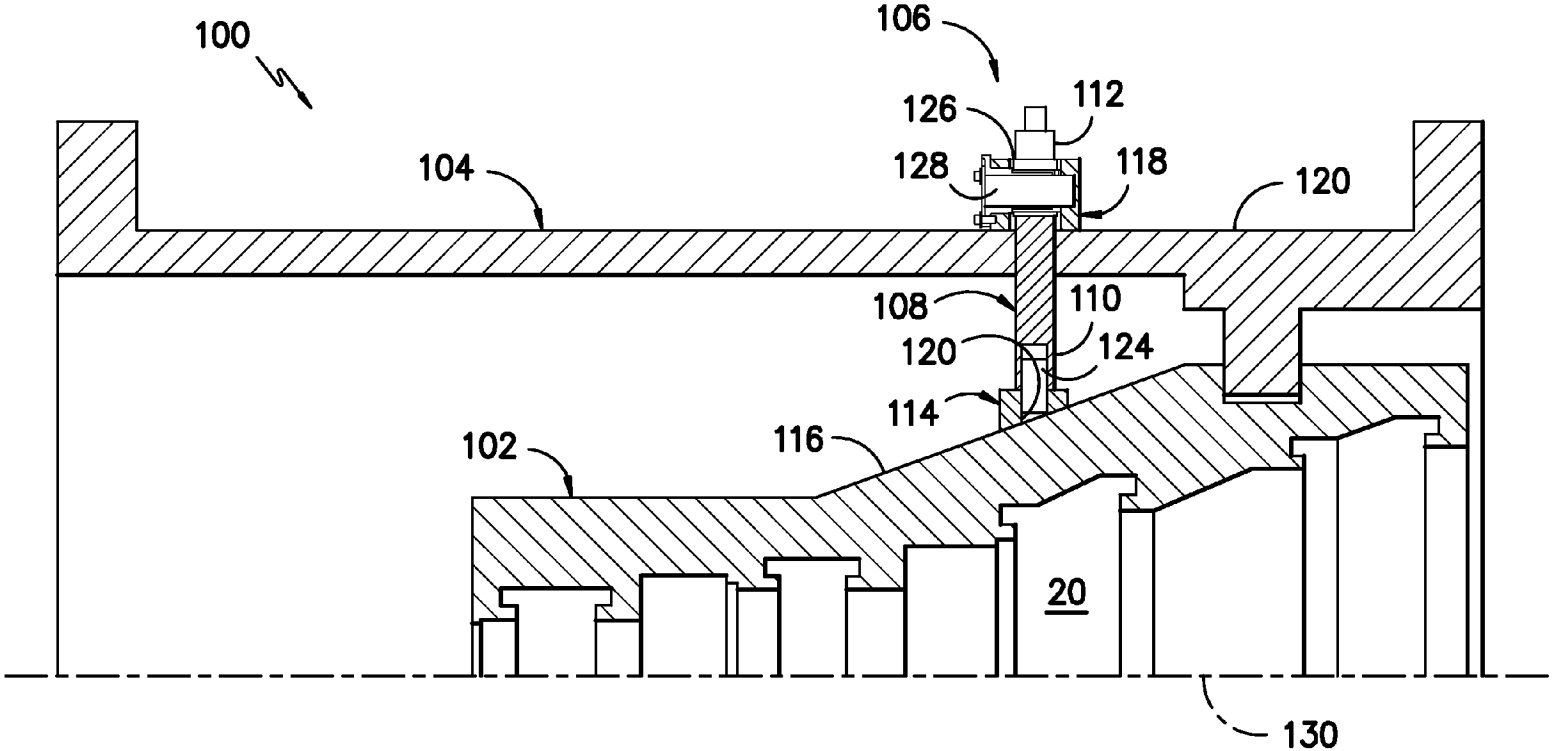
FIG. 3 illustrates a cross-sectional view of the casing assembly shown in FIG. 2 taken along line 3-3.

Referring now to FIGS. 2 and 3, one embodiment of a casing assembly 100 suitable for use with the gas turbine 10 shown in FIG. 1 is illustrated in accordance with aspects of the present subject matter. In particular, FIG. 2 illustrates a perspective view of the casing assembly 100. Additionally, FIG. 3 illustrates a partial, cross-sectional view of the casing assembly 100 shown in FIG. 2 taken along line 3-3.

It should be appreciated by those of ordinary skill in the art that, although the present subject matter will be described generally in the context of a casing assembly 100 surrounding a turbine rotor 20 of a gas turbine 10 (FIG. 1), the casing assembly 100 disclosed herein may also be used as a casing assembly for a gas turbine compressor or for any other suitable equipment having rotating components therein.

As shown in FIGS. 2 and 3, the casing assembly 100 generally includes at least one inner shell 102 encased by an outer shell 104. In general, the inner shell 102 may have any suitable configuration designed to surround the rotating components being encased within the casing assembly 100. Thus, in several embodiments, the inner shell 102 may comprise one or more inner turbine shells having an arcuate or circular shape configured to conform to and/or surround the turbine rotor 20 of a gas turbine 10 (FIG. 1). For example, in one embodiment, the inner shell 102 may comprise a single inner turbine shell configured to conform to and/or surround all of the stages of rotating turbine buckets 24 (FIG. 1) of the turbine rotor 20. Alternatively, the inner shell 102 may comprise multiple inner turbine shells, such as by comprising a first inner turbine shell configured to surround a first stage of rotating turbine buckets 24, a second inner turbine shell configured to surround a second stage of rotating turbine buckets 24 and so forth. Additionally, in one embodiment, the inner shell 102 may be configured as a continuous ring defining the entire arcuate or circular shape of the shell 102. Alternatively, the inner shell 102 may be composed of a plurality of curved sections configured to abut one another so as to generally define the arcuate or circular shape.

The outer shell 104 of the casing assembly 100 may generally have any suitable configuration designed to surround or encase the inner shell 102. For example, in several embodiments, the outer shell 104 may be arcuate or circular in shape so to generally correspond to the arcuate or circular shape of the inner shell 102. Additionally, similar to the inner shell 102, the outer shell 104 may be configured as continuous ring defining the arcuate or circular shape of the shell 104 or as a plurality of curved sections designed to abut one another so as to generally define the shell's shape.

It should be appreciated that the inner and outer shells 102, 104 may generally be formed from any suitable material capable of withstanding the temperatures associated with the combustion gases flowing through the turbine section 16 of the gas turbine 10 (FIG. 1). For example, in several embodiments, the inner and outer shells 102, 104 may be fabricated from various suitable alloys, superalloys or coated ceramics.

Referring still to FIGS. 2 and 3, the casing assembly 100 may also include a system 106 for mounting and aligning the inner shell 102 within the outer shell 104. For example, in several embodiments, the system 106 may include one or more connector arms 108 configured to extend radially between the inner and outer shells 102, 104. In particular, each connector arm 108 may generally include a first end 110 configured to be coupled to a portion of the inner shell 102 and a second end 112 configured to be coupled to a portion of the outer shell 104. For instance, as shown in FIG. 3, the first end 110 of each connector arm 108 may be coupled to a flange or inner boss 114 extending radially from an exterior surface 116 of the inner shell 102. Similarly, the second end 112 of each connector arm 108 may be coupled to a flange or outer boss 118 extending radially from an exterior surface 120 of the outer shell 104.

It should be appreciated that the disclosed system 106 may generally include any suitable number of connector arms 108 extending between the inner and outer shells 102, 104. Similarly, the inner and outer shells 102, 104 may include a like number of inner and outer bosses 114, 118, respectively, for coupling each connector arm 108 between the shells 102, 104. For example, in one embodiment, the system may include four connector arms 108 extending radially between corresponding inner and outer bosses 114, 118, with the connector arms 108 being circumferentially spaced ninety degrees apart between the shells 102, 104. However, in alternative embodiments, the system 106 may include any other suitable number of connector arms 108 having any suitable circumferential spacing relative to one another.

It should also be appreciated that the connector arms 108 may generally be fabricated using any suitable material. For example, in several embodiments, the connector arms 108 may be formed from a rigid or substantially rigid material, such as alloys, superalloys and the like, capable of radially supporting the inner shell 102 within the outer shell 104.

Additionally, the inner and outer bosses 114, 118 may generally comprise any suitable attachment structure that allows each connector arm 108 to be secured between the shells 102, 104 using any suitable means. Thus, in several embodiments, each inner boss 114 may define a radially extending opening, channel and/or pocket 122 configured such that the first end 110 of each connector arm 108 may be coupled to the inner shell 102 using any suitable fastening mechanism or other suitable attachment means. For instance, as shown in FIG. 3, a bolt or pin 124 (e.g., a shear pin) may be secured to the first end 110 of each connector arm 108 and may extend radially within the pocket 124 defined by each inner boss 118 in order to provide a means for coupling the connector arm 108 to the inner shell 102.

Similarly, in several embodiments, each outer boss 118 may define a radially extending opening, channel and/or pocket 126 configured such that the second end 112 of each connector arm 108 may be coupled to the outer shell 104 using any suitable fastening mechanism or other suitable attachment means. For instance, as will be described in detail below with reference to FIGS. 4-7, a shell alignment assembly 128 may be axially inserted through portions of each outer boss 118 and the second end 112 of each connector arm 108 in order to provide a means for both coupling the connector arm 108 to the outer shell 104 and aligning the inner shell 102 relative a centerline 130 of the turbine rotor 20.

It should be appreciated that, in one embodiment, the inner and outer bosses 114, 118 may be formed integrally with the inner and outer shells 102, 104, respectively. Alternatively, the inner and outer bosses 114, 118 may be manufactured as separated components and may be configured to be separately attached to the inner and outer shells 102, 104. For example, in several embodiments, the bosses 114, 118 may be secured to their respective shells 102, 104 by welding such components together, by using suitable mechanical fasteners (e.g., bolts, screws, pins, rivets, brackets and/or the like) and/or by using any other suitable attachment means.

Figure 4:
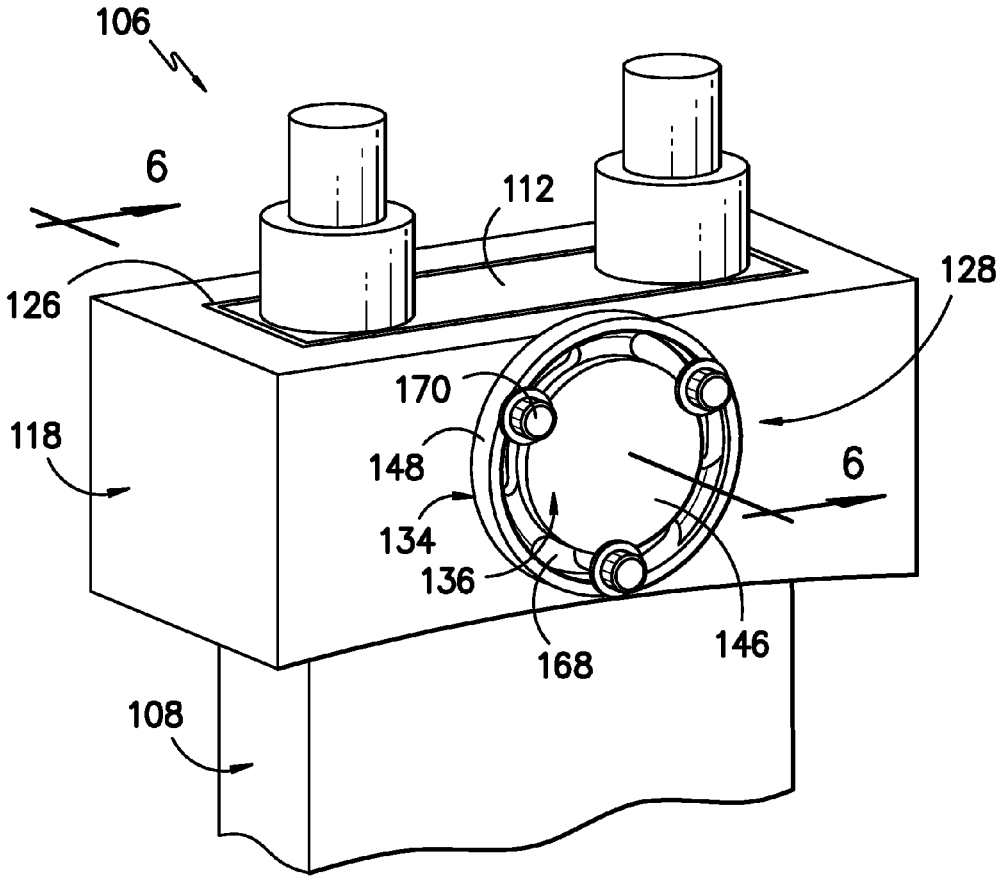
FIG. 4 illustrates a partial, perspective view of one embodiment of a system for mounting and aligning an inner shell of the disclosed casing assembly within an outer shell of the casing assembly, particularly illustrating one embodiment of a shell alignment assembly installed within components of the system.
Figure 5:
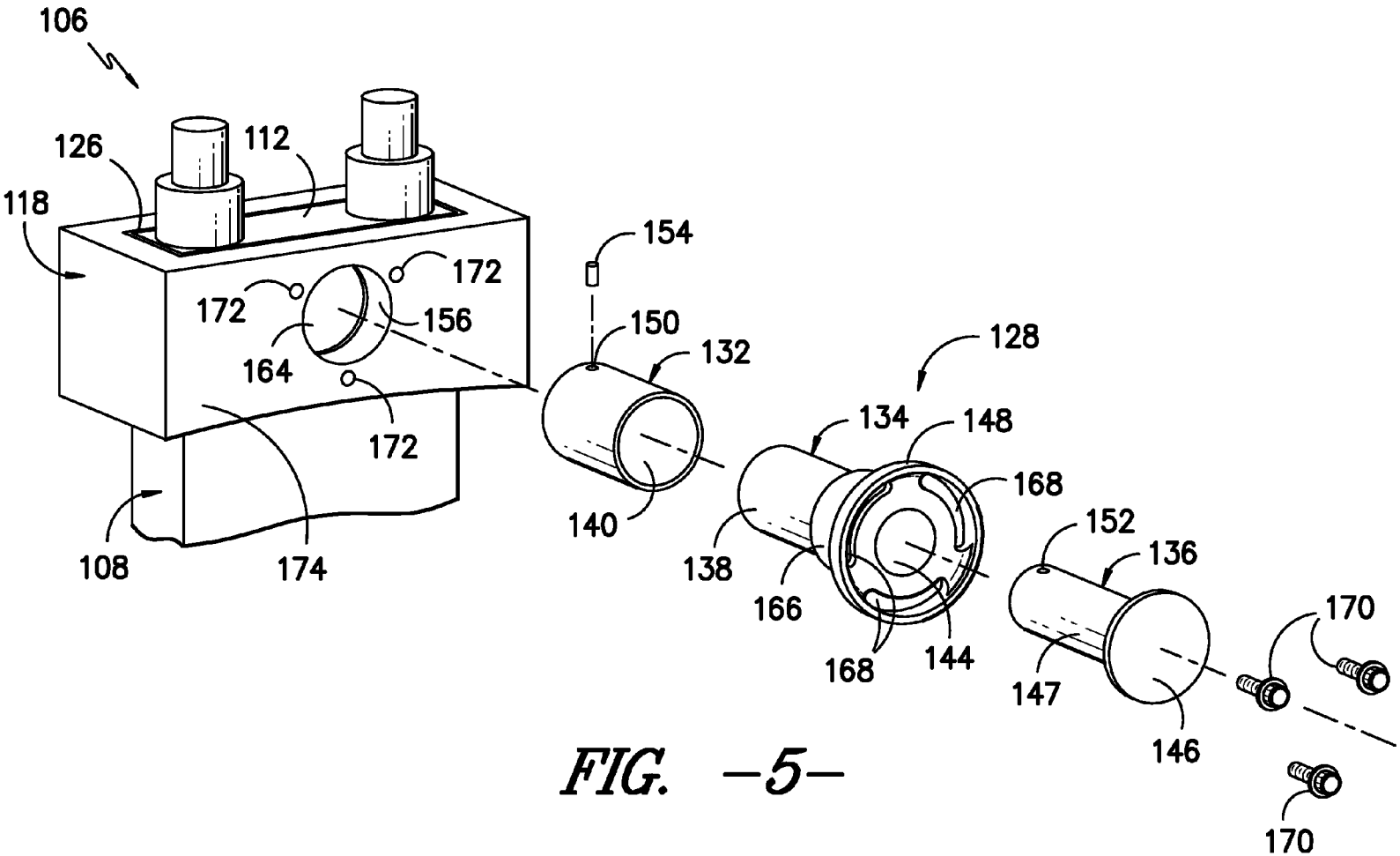
FIG. 5 illustrates an exploded view of the shell alignment assembly shown in FIG. 4.
Figure 6:
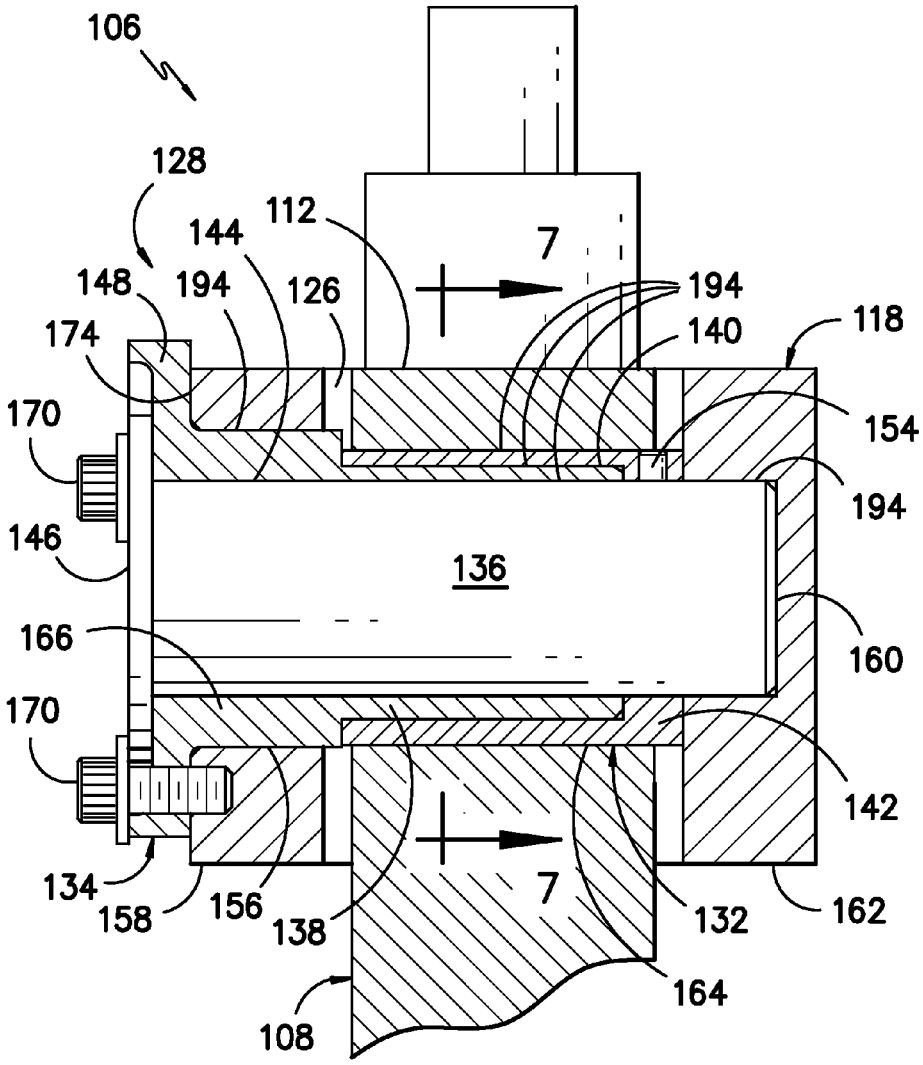
FIG. 6 illustrates a cross-sectional view of the shell alignment assembly and other components of the disclosed system shown in FIG. 4 taken along line 6-6.

Referring now to FIGS. 4-7, one embodiment of a shell alignment assembly 128 suitable for use with the disclosed system 106 is illustrated in accordance with aspects of the present subject matter. In particular, FIG. 4, illustrates a perspective view of the shell alignment assembly 128 installed within the outer boss 118 and the connector arm 108 of the disclosed system 106, with the outer shell 104 removed for purposes of illustration. FIG. 5 illustrates an exploded view of the shell alignment assembly 128 shown in FIG. 4. FIG. 6 illustrates a cross-sectional view of portions of the outer boss 118, connector arm 108 and shell alignment assembly 128 shown in FIG. 3 taken along line 6-6. Additionally, FIG. 7 illustrates a cross-sectional view of portions of the shell alignment assembly 128 shown in FIG. 6 taken along line 7-7.

As shown, the shell alignment assembly 128 generally includes a first bushing 132, a second bushing 134 and a connection member 136. In general, the first bushing 132 may comprise a tubular shaped member configured to receive a forward portion 138 of the second bushing 134. Thus, in several embodiments, an axially extending passage 140 may be defined in the first bushing 132 for receiving the forward portion 138. For example, as shown in FIG. 6, the passage 140 may be formed in the first bushing 132 such that the forward portion 138 may extend axially within the passage 140 to a circumferential lip 142 extending radially around the inner perimeter of the bushing 132. As such, the circumferential lip 142 may generally serve as an axial stop for the second bushing 134 as the forward portion 138 is inserted within the passage 140.

In addition, the second bushing 134 may generally comprise a tubular shaped member configured to receive the connection member 136. Thus, in several embodiments, an axially extending passage 144 may be defined in the second bushing 134 for receiving the connection member 136. For example, as shown in FIG. 6, the passage 144 may be formed in the second bushing 134 such that the connection member 136 may extend axially through the entire bushing 134. In such an embodiment, the connection member 136 may include a flange 146 configured to engage a portion of the second bushing 134 when the connection member 136 has been properly installed through the bushing 134. For instance, the flange 146 may be configured to axially engage a circumferential flange 148 of the second bushing 134 when the connection member 136 is sufficiently inserted within the bushing 134.

Moreover, as shown in FIG. 6, the connection member 136 may also be configured to extend axially through the portion of the passage 140 defined by the circumferential lip 142 of the first bushing 132. In such an embodiment, a pinned connection may be formed between the connection member 136 and the first bushing 132 for rotatably coupling such components to one another. For instance, as shown in FIGS. 5 and 6, a radially extending first hole 150 may be formed through the circumferential lip 142 of the first bushing 132 and a radially extending second hole 152 may be formed in the connection member 136 for receiving a pin 154 (e.g., a dowel or any other suitable pin) or other suitable retention device. The first and second holes 150, 152 may generally be defined in the first bushing 132 and the connection member 136 so that, when the connection member 136 is properly inserted through the second bushing 134, the first hole 150 is aligned with the second hole 152. As such, the pin 154 or other suitable retention device may be pressed through the aligned holes 150, 152 in order to rotatably couple the first bushing 132 to the connection member 136.

It should be appreciated that connection member 136 may generally comprise any suitable member configured to be received within the first and/or second bushings 132, 134. For example, as shown in the illustrated embodiment, the connection member 136 has a bolt-like configuration and includes a narrowed body 147 (FIG. 5) extending axially from the flange 146. In other embodiments, the connection member 136 may have a pin-like configuration or any other suitable configuration that permits the connection member 136 to function as described herein.

Once assembled, the shell alignment assembly 128 may generally be configured to provide a means for mounting the inner shell 102 within the outer shell 104. Thus, in several embodiments of the present subject matter, the shell alignment assembly 128 may be configured to be axially inserted through the outer boss 118 and the second end 112 of the connecter arm 108 in order to radially retain the connector arm 108 within the outer boss 118. For example, as shown in FIGS. 5 and 6, an axially extending boss opening 156 may be defined through a first side 158 of the outer boss 118 and an axially extending boss cavity 160 may be defined in a second side 162 of the outer boss 118. Similarly, an axially extending arm opening 164 may be defined through the connector arm 108 so that, when the second end 112 of the connector arm 108 is inserted within the outer boss 118, the arm opening 164 may be axially aligned with the boss opening 156 and the boss cavity 158. As such, the shell alignment assembly 128 may be inserted through the outer boss 118 and connector arm 108 in order to radially support the connector arm 108 within the outer boss 118.

Specifically, as shown in FIG. 6, when the shell alignment assembly 128 is installed through the outer boss 118 and connector arm 108, the first bushing 132 may be configured to radially engage the connector arm 108 around at least a portion of the perimeter of the arm opening 164. Additionally, the second bushing 134 and the connection member 136 may be configured to radially engage each side 158, 162 of the outer boss 118. For instance, in the illustrated embodiment, the second bushing 134 may include an aft portion 166 extending axially between the flange 148 and the forward portion 138 that has dimensions generally corresponding to the dimensions of the boss opening 156. As such, when the shell alignment assembly 128 is inserted through the outer boss 118, the aft portion 166 of the second bushing 134 may radially engage the first side 158 of the outer boss 119 around at least a portion of the perimeter of the boss opening 156. Similarly, the connection member 136 may be configured to extend axially through the first and second bushings 132, 134 and into the boss cavity 160 so as to radially engage the second side 162 of the outer boss 118. Accordingly, any radial loads passing through the connector arm 108 may be transmitted through the shell alignment assembly 128 to each side 158, 162 of the outer boss 118.

It should be appreciated that the shell alignment assembly 128 may be configured to be axially retained within the outer boss 118 and connector arm 108 using any suitable means known in the art. For example, in several embodiments, the shell alignment assembly 128 may be axially retained within the outer boss 118 and connector arm 108 using one or more mechanical fasteners configured to be secure to a portion of the outer boss 118. In particular, as shown in FIGS. 4 and 5, in one embodiment, the flange 148 of the second bushing 134 may include one or more openings or slots 168 for receiving a plurality of attachment bolts 170 (e.g., friction bolts) configured to be pressed and/or screwed into a corresponding number of bolt holes 172 defined through an outer surface 174 of the outer boss 118. As such, when the attachment bolts 170 are inserted through the slots 168 and pressed and/or screwed into the bolt holes 172, the head of each bolt 170 (or an associated washer) may engage the flange 148 of the second bushing 134 and/or the flange 146 of the connection member 136, thereby axially retaining the shell alignment assembly 128 within the outer boss 118.

In addition to providing a means for mounting the inner shell 102 within the outer shell 104, the shell alignment assembly 128 may also be configured to provide a means for aligning the inner shell 102 relative to the centerline 130 of the turbine rotor 20. For example, in several embodiments of the present subject matter, the first bushing 132 and the forward portion 138 of the second bushing 134 may each have an eccentric configuration. Accordingly, by rotating the first and second bushings 132, 134 relative to one another, the position of the connecter arm 108 relative to the outer boss 118 and, thus, the position of the inner shell 102 relative to the outer shell 104 and/or the rotor centerline 130, may be adjusted.

For example, as shown in FIG. 7, the first bushing 132 may generally be configured so that a center 176 of the outer diameter defined by the bushing 132 is offset from a center 178 of the inner diameter defined by the bushing 132. As such, the first bushing 132 may generally define a maximum wall thickness 180 and a minimum wall thickness 182 and may have an eccentricity equal to one-half the difference between the maximum and minimum wall thicknesses 180, 182. Similarly, the forward portion 138 of the second bushing 134 may generally be configured so that the center 178 of the outer diameter defined by the forward portion 138 (generally corresponding to the center 178 of the inner diameter defined by the first bushing 132) is offset from a center 184 of the inner diameter defined by the forward portion 138. Thus, similar to the first bushing 132, the forward portion 138 may generally define a maximum wall thickness 186 and a minimum wall thickness 188 and may have an eccentricity equal to one-half the difference between the maximum and minimum wall thicknesses 186, 188

By designing the shell alignment assembly 128 to have a double eccentric bushing configuration, the alignment of the inner shell 102 relative to the outer shell 104 and/or the rotor centerline 130 may be adjusted both radially (indicated by arrow 190) and tangentially (indicated by arrow 192) from a location exterior of the outer shell 104. For instance, as shown in FIG. 7, the maximum wall thicknesses 180, 186 of the first bushing 132 and the forward portion 138 of the second bushing 134 are both positioned at the circumferential position A. As such, the radial location of the center 184 of the connection member 136 (generally corresponding to the center 184 of the inner diameter defined by the forward portion 138) and, thus, the radial location of the connector arm 108 relative to the outer boss 118 may be at a maximum radial location. However, by rotating the first and second bushings 132, 134 one hundred and eighty degrees (i.e., so that the maximum wall thicknesses 180, 186 of the first bushing 132 and the forward portion 138 are both positioned at the circumferential position B), the radial location of the center 184 of the connection member 136 and, thus, the radial location of the connector arm 108 relative to the outer boss 118 may be at a minimum radial location. Accordingly, the radial alignment of the inner shell 102 relative to the outer shell 104 and/or the rotor centerline 130 may be adjusted as the radial location of the connector arm 108 is displaced between the maximum and minimum radial locations.

Similarly, the tangential alignment of the inner shell 102 relative to the outer shell 104 and/or the rotor centerline 130 may be adjusted by rotating the first and second bushings 132, 134. For instance, by rotating both the first and second bushings 132, 134 ninety degrees in the clockwise direction (i.e., so that the maximum wall thicknesses 180, 186 of the first bushing 132 and the forward portion 138 are both positioned at the circumferential position C), the tangential location of the center 184 of the connection member 136 and, thus, the tangential location of the connector arm 108 relative to the outer boss 118 may be at a maximum tangential location. Similarly, by rotating both the first and second bushings 132, 134 ninety degrees in the counterclockwise direction (i.e., so that the maximum wall thicknesses 180, 186 of the first bushing 132 and the forward portion 138 are both positioned at the circumferential position D), the tangential location of the center 184 of the connection member 136 and, thus, the tangential location of the connector arm 108 relative to the outer boss 118 may be at a minimum tangential location. Accordingly, the tangential alignment of the inner shell 102 relative to the outer shell 104 and/or the rotor centerline 130 may be adjusted as the tangential location of the connector arm 108 is displaced between the maximum and minimum tangential locations.

It should be appreciated by those of ordinary skill in the art that, by rotating the first and second bushings 132, 134 relative to one another, the connecter arm 108 may be disposed at various combinations of differing radial and tangential locations relative to the outer boss 118. Accordingly, the disclosed shell alignment assembly 128 may allow for precise alignment of the inner shell 102 relative to the outer shell 104 and/or the rotor centerline 130.

It should also be appreciated that the shape and/or dimensions of the first bushing 132, the second bushing 134 and the connection member 136, as well as the shape and/or dimensions of the boss opening 156, the arm opening 164 and the boss cavity 160, may generally be chosen such that the components of the shell alignment assembly 128 may be rotated relative to one another and/or relative to the outer boss 118 and the connecter arm 108. For example, as shown in FIG. 6, in several embodiments, a rotational interface 194 may be defined between the connector arm 108 and the first bushing 132, between the first bushing 132 and the second bushing 134, between the second bushing 134 and the connection member 136, between the second bushing 134 and the outer boss 118 and/or between the connection member 136 and the outer boss 118. As used herein, the term "rotational interface" refers to an interface between two components at which the components may rotate relative to one another. Thus, due to the rotational interfaces 194 defined between the components, the first bushing 132, for example, may be rotated relative to the second bushing 134 and the connector arm 108 by simply rotating the connection member 136, which may be rotatably coupled to the first bushing 132 through the pinned connection described above.

Additionally, it should also be appreciated that the various rotational interfaces 194 defined between the components may be achieved using any suitable means known in the art. For example, in one embodiment, the components may be shaped and/or dimensioned such that a tight machine fit or a locational clearance fit exits at each rotational interface 194. Alternatively, suitable rotational devices (e.g., bearings) may be disposed at each rotational interface 194 to allow adjacent components to rotate relative to one another.

Further, it should be appreciated the slots 168 defined in the flange 146 of the second bushing 134 may be designed to accommodate rotation of the second bushing 134 relative to the first bushing 132. For example, as shown in FIG. 4, in one embodiment, the slots 168 may be arcuate in shape and may define a radius of curvature generally corresponding to the radius of the flange 146 at the circumferential location of each slot 168. As such, when the second bushing 134 is rotated relative to the first bushing 132, the circumferential position of each attachment bolt 170 within each arcuate slot 168 may generally change depending on the degree of rotation of the second bushing 134.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An alignment assembly for mounting and aligning an inner shell within an outer shell, wherein an arm extends radially between the inner and outer shells and includes an outer end extending radially outwardly from the outer shell, the alignment assembly comprising:

a first bushing configured to be received within an arm opening defined through the outer end of the arm, said first bushing having an eccentric configuration;

a second bushing configured to extend through an outer boss extending radially outwardly from the outer shell so as to be received within the arm opening, said second bushing including an eccentric portion extending within said first bushing, said second bushing including a circumferential flange;

a connection member extending at least partially through said first bushing and said second bushing; and at least one fastener configured to secure said circumferential flange to the outer boss, wherein said circumferential flange defines at least one arcuate slot configured to receive said at least one fastener.

2. The alignment assembly of claim 1, wherein said first bushing defines an axially extending passage configured to receive said eccentric portion.

3. The alignment assembly of claim 2, further comprising a circumferential lip extending within said axially extending passage.

4. The alignment assembly of claim 3, further comprising a pin extending radially between said first bushing and said connection member, said pin being configured to couple said circumferential lip to said connection member.

5. The alignment assembly of claim 1, wherein said connection member includes a flange, said flange being configured to engage said circumferential flange when said connection member is inserted through said second bushing.

6. The alignment assembly of claim 1, wherein a rotational interface is defined between said connection member and said second bushing and between said eccentric portion and said first bushing.

7. A casing assembly, comprising:

an inner shell;

an outer shell surrounding said inner shell, said outer shell including a boss extending radially outwardly from a surface of said outer shell;

an arm extending radially between the inner and outer shells, said arm including a first end and a second end, said first end being coupled to said inner shell, said second end extending radially outwardly from the outer shell adjacent to said boss; and an alignment assembly extending through at least a portion of said second end of said arm and said boss, said alignment assembly comprising:

a first bushing having an eccentric configuration;

a second bushing including an eccentric portion extending within said first bushing, said first bushing defining an axially extending passage configured to receive said eccentric portion, said axially extending passage including a circumferential lip;

a connection member extending within at least one of said first bushing and said second bushing; and a radially extending pin configured to couple said circumferential lip to said connection member.

8. The casing assembly of claim 7, wherein said arm defines an arm opening at said second end, at least a portion of said first bushing extending axially within said arm opening.

9. The easing assembly of claim 8, wherein said boss defines a boss opening generally aligned with said arm opening, at least a portion of said second bushing extending axially within said boss opening.

10. The casing assembly of claim 9, wherein said boss further defines a boss cavity generally aligned with said boss opening, at least a portion of said connection member extending axially within said boss cavity.

11. The easing assembly of claim 7, wherein a rotational interface is defined between said connection member and said second bushing and between said second bushing and said first bushing.

12. The casing assembly of claim 7, wherein said second bushing includes a circumferential flange configured to engage an outer surface of said boss.

13. The casing assembly of claim 12, further comprising at least one fastener configured to secure said circumferential flange to said outer surface, said circumferential flange defining at least one arcuate slot configured to receive said at least one fastener.

14. An alignment assembly for mounting and aligning an inner shell within an outer shell wherein an arm extends radially between the inner and outer shells, the alignment assembly comprising:

a first bushing configured to be received within at least one of the arm and a boss of the outer shell, said first bushing having an eccentric configuration and defining an axially extending passage, said first bushing including a circumferential lip extending within said axially extending passage;

a second bushing configured to be received within at least one of the arm and the boss, said second bushing including an eccentric portion extending configured to be received within said axially extending passage defined in said first bushing; and a connection member extending within at least one of said first bushing and said second bushing.

15. The alignment assembly of claim 14, further comprising a pin extending radially between said first bushing and said connection member, said pin being configured to couple said circumferential lip to said connection member.

* * * * *